United States Patent [19]

Gordon et al.

[11] 3,961,721

[45] June 8, 1976

[54] MAGNETIC CONTAINER COVER

[76] Inventors: Edwin J. Gordon; Adam I. Gordon, both of 1208 Brooklands Road, Kettering, Ohio 45409

[22] Filed: Nov. 28, 1975

[21] Appl. No.: 636,247

[52] U.S. Cl. ..... 220/230; 220/315; 220/337; 206/818

[51] Int. Cl.[2] ..... B65D 55/00

[58] Field of Search ..... 220/230, 315, 334, 337, 220/375, 379; 206/818; 229/44 R, 47

[56] References Cited

UNITED STATES PATENTS 2,672,257 3/1954 Simmonds ..... 220/230

3,749,301 7/1973 Peckar ..... 220/315 X

*Primary Examiner*—George T. Hall

*Attorney, Agent, or Firm*—Reuben Wolk

[57] ABSTRACT

A removable flexible cover for a metal container with magnetic means incorporated within the cover to secure it in place, while providing hinge means so that the cover may be swung out of position but retained on the container.

10 Claims, 5 Drawing Figures

MAGNETIC CONTAINER COVER

BACKGROUND OF THE INVENTION

This invention refers to container covers; particularly for such containers as tennis ball cans. More specifically the type of covers are those used as replacements for the original covers which are usually made as part of the container or can.

Tennis ball cans in particular require special replacement covers. After the original cover is pulled off the metal can in which the balls are vacuum sealed, it is necessary to utilize another cover that can be easily applied to or removed from the can to permit easy access when the balls are being replaced in or removed from the can. The present practice is to place a flexible cover over the open end of the can. Such covers are not always satisfactory, however, because they may not fit accurately and then they fall off and are lost; or they may be put aside when the balls are removed and accidentally discarded.

SUMMARY OF THE INVENTION

In accordance with the present invention, a flexible cover is provided for a container that is not only simple to apply and remove, but is secured to the container by magnetic means that are incorporated within the cover. This consists of one or more integral tabs which is magnetically secured to the container so that when the cover is pulled back, it remains in position so that it will not fall off. The magnetic forces, however, are not great and the cover may be easily removed for re-use on another container.

DESCRIPTION OF THE PREFERRED EMBODIMENT

Figure 1:
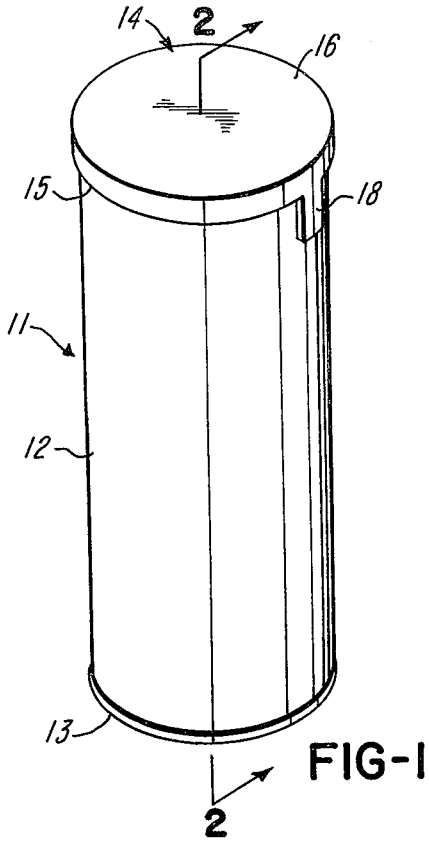
FIG. 1 is a perspective view of the novel container and cover, illustrating their assembled relationship.
Figure 2:
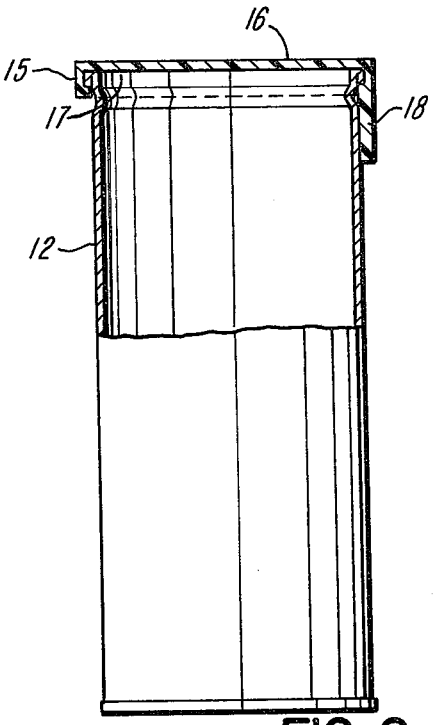
FIG. 2 is a sectional view taken along line 2—2 of FIG. 1.
Figure 3:
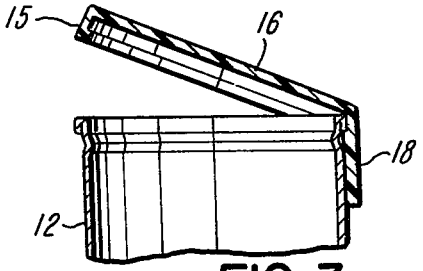
FIG. 3 is a view similar to FIG. 1, illustrating the open position of the cover.

Referring now to FIG. 1, the novel assembly consists of a cylindrical metal container or can 11 and cover or lid 14. The container consists of a continuous outer surface 12, a bottom 13, and an upper opening 17. The cover consists of a flat circular portion 16, terminating in a flange 15, and is preferably made of a flexible plastic material such as polyethylene, polypropylene, or polyvinyl chloride. However, other plastic materials or rubber may be utilized. The dimensions of the container and cover are such that the flange 15 fits around the outer surface 12 to create a frictional fit and thus the cover closes off the opening 17. Extending downward as an integral part of flange 15 is a tab 18, which has been impregnated with magnetic particles much in the manner described in U.S. Pat. Nos. 3,124,725 and 3,184,807. The tab 18 extends farther down the outer surface 12 and in contact therewith, and adheres to the surface because of its magnetic properties. This insures that the cover 14 is retained in place; in addition, as shown in FIG. 3, the tab 18 acts as a hinge so that when lifting the cover to provide access to the container through opening 17, the cover is still held on to the container so that it will not fall off.

Figure 4:
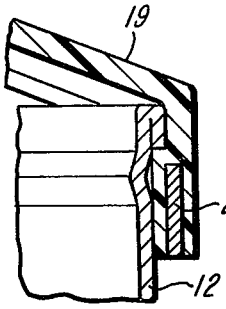
FIG. 4 is a view similar to FIG. 3, illustrating a modified form of the invention.

FIG. 4 represents a variation in the magnet design. In this modification the tab 19, instead of having magnetic particles therein, has a magnet 20 inserted and embedded therein. The tab 19 is otherwise just like tab 18 in design, and is also an integral part of cover 14.

Figure 5:
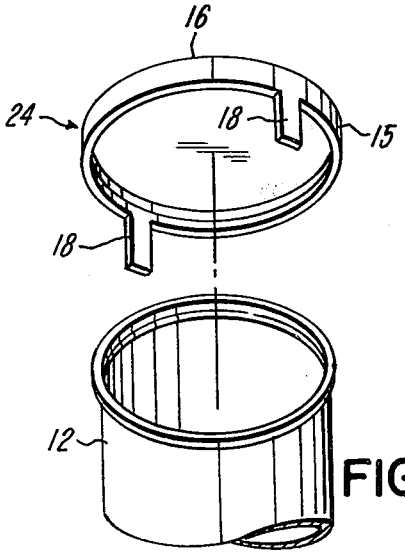
FIG. 5 is an exploded perspective view illustrating another form of the invention.

FIG. 5 represents a modification in which the cover 14 has two tabs 18 which are oppositely located. The use of twin tabs improves the tightness of fit of the cover on the container, and also provides added versatility in that either of the tabs may be used as the hinge.

Other modifications may be made within the scope of the invention.

What is claimed is:

1. In combination with a metal container comprising a cylindrical wall and having an open top and a closed bottom; a removable flexible cover comprising a flat circular body having a downturned flange; the inner surface of said flange frictionally engaging the outer surface of said wall; said flange having at least one integral downwardly extending magnetic member contacting said wall to secure said cover thereon.

2. The cover of claim 1 in which said magnetic member has a magnet embedded therein.

3. The cover of claim 1 in which said magnetic member is formed by incorporating magnetic particles therein.

4. The cover of claim 1 in which said member remains in contact with the outer surface of said wall when the cover is moved to expose said open top.

5. The cover of claim 1 in which said flange has two downwardly extending magnetic tabs contacting said wall.

6. A flexible removable cover for a metal container which comprises a cylindrical wall; said cover consisting of a flat circular body, a downturned flange, and an integral downwardly extending magnetic tab, said flange and said tab frictionally engaging said wall to secure said cover when mounted on said container.

7. The cover of claim 1 in which said tab has a magnet embedded therein.

8. The cover of claim 1 in which said tab has magnetic particles.

9. The cover of claim 1 in which said tab remains in contact with said wall and serves as a hinge when said cover is moved away from said container.

10. The cover of claim 1 in which said flange has two downwardly extending magnetic tabs.

* * * * *